US007481193B2

(12) United States Patent
Takami et al.

(10) Patent No.: US 7,481,193 B2
(45) Date of Patent: Jan. 27, 2009

(54) ENGINE

(75) Inventors: Masayasu Takami, Osaka (JP); Tadao Yamato, Osaka (JP); Tetsuya Kosaka, Osaka (JP); Yoshikazu Takemoto, Osaka (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 11/685,835

(22) Filed: Mar. 14, 2007

(65) Prior Publication Data

US 2007/0227502 A1 Oct. 4, 2007

(30) Foreign Application Priority Data

Mar. 30, 2006 (JP) ..... 2006-092943

(51) Int. Cl.
*F02N 17/00* (2006.01)

(52) U.S. Cl. ..... 123/179.1; 123/179.2

(58) Field of Classification Search ..... 123/500, 123/501, 502; 464/2, 3, 4, 5, 6
See application file for complete search history.

(56) References Cited

U.S. PATENT DOCUMENTS 4,497,303 A * 2/1985 Murayama et al. ..... 123/501
7,252,073 B1 * 8/2007 Nakahira et al. ..... 123/501
7,308,878 B2 * 12/2007 Kira ..... 123/90.17

FOREIGN PATENT DOCUMENTS

| | | | |
|---|---|---|---|
| JP | 2003074377 | A | 3/2003 |
| JP | 2003097297 | A | 4/2003 |
| JP | 2004116500 | A | 4/2004 |
| JP | 2004300986 | A | 10/2004 |
| JP | 2005273519 | A | 10/2005 |
| JP | 2006090213 | A | 4/2006 |
| JP | 2006250013 | A | 9/2006 |
| JP | 200716744 | A | 1/2007 |

* cited by examiner

*Primary Examiner*—Stephen K Cronin
*Assistant Examiner*—Keith Coleman
(74) *Attorney, Agent, or Firm*—Panitch Schwarze Belisario & Nadel LLP

(57) ABSTRACT

An engine comprises a timer (20), which is provided with a temperature-sensing operation mechanism (7). During a cold-starting term, a downstream interlocking portion (2) advances by an advancing operation of the timer (20) based on an operation that the temperature-sensing operation mechanism (7) makes upon sensing the temperature. While the engine is warm, the downstream interlocking portion (2) cancels an advancement by an advancement-cancellation operation of the timer (20) based on another operation that the temperature-sensing operation mechanism (7) makes upon sensing the temperature. The engine oil (56) within the engine is supplied from the oil-supply port (58) to the timer (20), thereby enabling the engine oil (56) in liquid state to contact the temperature-sensing operation mechanism (7).

21 Claims, 11 Drawing Sheets

20
14
6
7(8)
9
5
28
2
3
3e
18
(8)7
59
27a
27
27b
25c
41
2e
29
25a
25
24
4
3d
2(2c)
1a
44
(44a)
56
58
48
58a
76
88
1c
C
B
2d
1(1b)
(21)
1d
2b
23

ENGINE

BACKGROUND OF THE INVENTION

The present invention concerns an engine and more specifically, an engine able to promptly cancel its advancement after starting during a cold term.

There is an example of the conventional engines which comprises an upstream interlocking portion near a crank shaft, interlockingly connected through a timer to a downstream interlocking portions as well as the present invention. This timer is provided with a temperature-sensing operation means. During a cold-starting term while the temperature-sensing operation means senses a temperature of a value less than a predetermined one, the downstream interlocking portion advances by an advancing operation of the timer based on an operation the temperature-sensing operation means makes upon sensing the temperature. During a warm term of the engine while the temperature-sensing operation means senses a temperature of a value not less than the predetermined value, the advancement of the downstream interlocking portion is cancelled by an advancement-cancellation by an advancement-cancellation operation of the timer based on another operation the temperature-sensing operation means makes upon sensing the temperature.

The engine of this kind has the following advantages.

When the engine starts during the cold term, the timer advances the downstream interlocking portion to enhance the starting ability. After the cold-starting, the timer cancels the advancement of the downstream interlocking portion in an attempt to reduce Nox and noise.

However, in the case of the conventional engine, the temperature-sensing operation means senses merely the atmospheric temperature in the vicinity thereof to operate. This entails problems.

The conventional technique has the following problems.

The advancement is canceled in delay after the cold-starting.

The temperature-sensing means senses only the atmospheric temperature in the vicinity thereof to operate. Therefore, even if the engine has its temperature increased after the cold-starting, it takes much time for the increased temperature to be transmitted to the temperature-sensing operation means to delay the cancellation of the advancement after the cold-starting with the result of reducing the exhaust-gas property.

BRIEF SUMMARY OF THE INVENTION

The present invention has an object to provide an engine capable of solving the above-mentioned problems. Mores specifically, it aims at providing an engine able to promptly perform the advancement-cancellation after the cold-starting.

As exemplified in FIG. 1, FIGS. 2 (A) to 2(C) or FIGS. 8(A) and 8(B), an engine comprises an upstream interlocking portion 1 near a crank shaft 49, interlockingly connected through a timer 20 to a downstream interlocking portion 2. This timer 20 is provided with a temperature-sensing operation means 7. During a cold-starting term while the temperature-sensing operation means 7 senses a temperature of a value less than a predetermined one, the downstream interlocking portion 2 is advanced by the advancing operation of the timer 20 based on an operation the temperature-sensing operation means 7 makes upon sensing the temperature. During an engine-warm term while the temperature-sensing operation means 7 senses a temperature of a value not less than the predetermined one, the advancement of the downstream interlocking portion 2 is cancelled by the advancement-cancellation operation of the timer 20 based on another operation the temperature-sensing operation means 7 makes upon sensing the temperature. In this engine, an oil pump 57 for an engine oil 56 is communicated with an oil-supply port 58. The engine oil is fed from the oil-supply port 58 to the timer 20, thereby enabling the engine oil 56 in liquid state to be brought into contact with the temperature-sensing operation means 7.

It is possible to cancel the advancement promptly after the cold-starting.

As exemplified in FIG. 1, FIGS. 2(A) to 2(C) or FIGS. 8(A) and 8(B), the engine oil 56 in liquid state is brought into contact with the temperature-sensing operation means 7. Thus after the cold-starting, the engine oil 56, which has its temperature increased promptly within the engine, contacts with the temperature-sensing operation means 7 at the liquid state to thereby immediately transmit the increase of the engine's temperature to the temperature-sensing operation means 7 with the result of being able to canceling the advancement after the cold-starting without delay. This enhances the exhaust-gas property.

It is possible to cancel the advancement immediately after the cold-starting.

As shown in FIG. 1 or FIG. 8(A), the timer 20 is arranged within a gear case 76 and the oil-supply port 58 is provided within the gear case 76. Further, the engine oil 56 fed from the oil-supply port 58 to the timer 20 is made to flow from the timer 20 into the gear case 76. Owing to this arrangement, the engine oil 56, which has its temperature increased immediately after the cold-starting within the engine, is splashed up by a gear within the gear case 76 to become oil mist that fills the interior area of the gear case 76 to thereby promptly increase the atmospheric temperature around the temperature-sensing operation means 7. This entails the possibility of promptly canceling the advancement after the cold-starting.

The timer can be arranged in a compact manner.

As exemplified in FIG. 1 or FIG. 8(A), an axial direction of a sleeve 2*c* is taken as a front and rear direction. The timer 20 and an upstream interlocking gear 1*b* are arranged side by side in the front and rear direction and they are externally fitted onto the sleeve 2*c* as they are. This can arrange the timer in a compact manner.

It is possible to dispose the timer in a compact manner.

As illustrated in FIG. 1 or FIG. 8(A), the upstream interlocking gear 1*b* has a front and a rear surfaces one of which is provided with a recess portion 1*c*. This recess portion 1*c* contains at least part of the timer 20. Therefore, the timer 20 can be arranged in a compact manner.

The timer can be made compact.

As exemplified in FIGS. 2(A) to 2(C) or FIG. 8(A), the temperature-sensing operation means 7 is formed from a shape-memory spring 8 and the timer 20 is composed of a cam-interlocking portion 3*e* and an eccentric cam mechanism 4. This construction can make the timer 20 compact.

It is possible to retain the accuracy of the timer at a high level.

As shown in FIG. 2(A) to FIG. 2(C), the engine oil 56 that is injected from the oil-supply port 58 into the sleeve 2*c* is flowed out of an oil flow-out port 2*d* and is fed to the timer 20, so that it is brought into contact with the temperature-sensing operation mans 7. Therefore, the engine oil 56 injected through the oil-supply port 58 does not vigorously collide against the timer 20 to result in being able to retain the accuracy of the timber 20 at a high level.

It is possible to maintain the accuracy of the timer at a high level.

As exemplified in FIG. 2(A), the engine oil 56 that is flowed out of the oil flow-out port 2*d* and is fed to the timer 20 is also supplied to between a centrifugal weight 3 and a guide plate 88. This arrangement can reduce the sliding resistance of the centrifugal weight 3 to the guide plate 88 with the result of being able to maintain the accuracy of the timer 20 at a high level.

The oil-supply port can be arranged easily.

As shown in FIG. 1, the oil-supply port 58 is arranged in a wall of the gear case 76. This enables the oil-supply port 58 to avoid the interference with the gears within the gear case 76 with the result of being able to be easily arranged.

The oil-piping can be readily arranged.

As exemplified in FIG. 1, an engine's wall is provided on its outer side with an external piping 58*a*. This external piping 58*a* communicates an oil gallery 58*c* within a cylinder block 58*b* with the oil-supply port 58 of the gear case 76. This allows the oil-piping to avoid the interference with the gears within the gear case 76 with the result of being able to facilitate the arrangement of the oil-piping.

The sleeve can be fixed in a compact manner.

As illustrated in FIG. 2(A), in order to fix the sleeve 2*c* to a downstream interlocking rotary shaft 2*b* by means of a fastening member 2*e*, the fastening member 2*e* is accommodated in the sleeve 2*c* to result in the possibility of securing the sleeve 2*c* in a compact manner.

It is possible to reduce the resistance of transmission from an advancing spring to a pair of centrifugal weights.

As shown in FIG. 3(A), the advancing spring 6 is interposed between a pair of centrifugal weights 3, 3 in a position concentric with the weight-return spring 5. This makes it possible for the spring force of the advancing spring 6 to directly push and widen the pair of centrifugal weights to an advancing position (Ac) for the cold-starting, without using the spring-force transmission means which changes the operation direction of the spring force of the advancing spring 6 such as a tapered cam. This can reduce the resistance of transmission from the advancing spring 6 to the pair of centrifugal weights 3, 3 with the result of increasing the accuracy of advancement when starting the engine during the cold term. Further, it suffices if the advancing spring 6 and the temperature-sensing operation means 7 may be small and may produce low output. Additionally, there is not caused the disadvantage of reducing the durability due to the wearing-off of the transmission portion.

The timer can be made compact.

As exemplified in FIG. 3(A), a shape memory spring 8 composed of a compression-coil spring is used for the temperature-sensing operation means 7. This shape-memory spring 8 and the advancing spring 6 are interposed between the pair of centrifugal weights 3, 3 in a position concentric with the weight-return spring 5. Therefore, as shown in FIG. 2(A), the timer 20 is small-sized. This makes it sufficient even if each of the advancing spring 6 and the temperature-sensing operation means 7 is small and produces a low output. In addition, the timer can be made compact.

It is possible to smoothly start the engine during the cold term and to improve the exhaust-gas property while the engine is warm.

As exemplified in FIG. 5(A), when starting the engine during the cold term, an upper limit of the movement of every centrifugal weight 3 in the centrifugal direction is confined to a first limiting position of advancement (L1). While the engine is warm, the upper limit of the movement of every centrifugal weight 3 in the centrifugal direction is confined to a second limiting position of advancement (L2). The second limiting position of advancement (L2) is arranged so that the upper limit of the movement of every centrifugal weight 3 in the centrifugal direction is set lower to make an upper limit of a degree of advancement (θ) lower when compared with the first limiting position of advancement (L1). This offers the following advantages.

When starting the engine during the cold term, the engine can be smoothly started by setting the upper limit of the degree of advancement (θ) higher. Besides, while the engine is warm, the exhaust-gas property can be improved by setting the upper limit of the degree of advancement (θ) lower.

It is possible to more promptly cancel the advancement after the cold-starting.

As illustrated in FIG. 8(A), the temperature-sensing operation means 7 is arranged as it is disclosed between a pair of support portions 60*b* and 59*b*. In consequence, the engine oil 56 fed from the oil-supply port 58 easily contacts with the temperature-sensing operation means 7 to thereby enhance the sensitivity of the temperature-sensing operation means 7 with the result of being able to more promptly cancel the advancement after the cold-starting.

A means for supplying the engine oil can be formed at a low cost.

As exemplified in FIG. 8(A), an idle gear 69 has a pivot axis 70 provided with an oil-supply passage 71, which supplies the engine oil 56 to between the idle gear 69 and the pivot axis 70. An extension passage 72 is conducted out of the oil-supply passage 71 at an end thereof. The end out of which the extension passage 72 is conducted serves as the oil-supply port 58 The oil engine 56 is injected through the oil-supply port 58 to the timer 20. Therefore, the engine oil 56 can be supplied by using the oil-supply passage 71 of the existing idle gear 69 with the result of being able to form the supply means for the engine oil 56 at a low cost.

The means for supplying the engine oil can be made inexpensively.

As illustrated in FIG. 8(B), a fall-out preventing plate 74 has a rear surface formed with a groove-like extension passage 72 extending along a leading-end surface 70*a* of the pivot axis 70 and has a peripheral edge opened to provide the oil-supply port 58. Consequently, the engine oil 56 can be supplied by utilizing the existing fall-out preventing plate 74, which entails the possibility of making the means for supplying the engine oil 56 inexpensively.

BRIEF DESCRIPTION OF THE SEVERAL VIEWS OF THE DRAWINGS

FIG. 2 shows a timer used for the engine shown in FIG. 1.

FIG. 3 is an explanatory view of the timer shown in FIG. 2.

FIG. 4 shows a state of a temperature-sensing operation means of the timer shown in FIG. 2 in which the temperature-sensing operation means senses a temperature to operate.

FIG. 5(A) shows a state when starting the engine during the cold term. FIG. 5(B) shows another state while the engine is warm.

FIG. 6 is a graph which shows a characteristic of the advancement limiting state of the timer shown in FIG. 2.

FIG. 11(A) explains an advancing operation of the timer and FIG. 11(B) explains an advancement-cancellation operation.

DETAILED DESCRIPTION OF THE INVENTION

Embodiments of the present invention are explained based on the drawings. FIGS. 1 to 7 show an engine according to a first embodiment of the present invention and FIGS. 8 to 11 show another engine in accordance with a second embodiment of the present invention. In these embodiments, an explanation is given for an upright multi-cylinder diesel engine.

The first embodiment of the present invention is outlined as follows.

Figure 1:
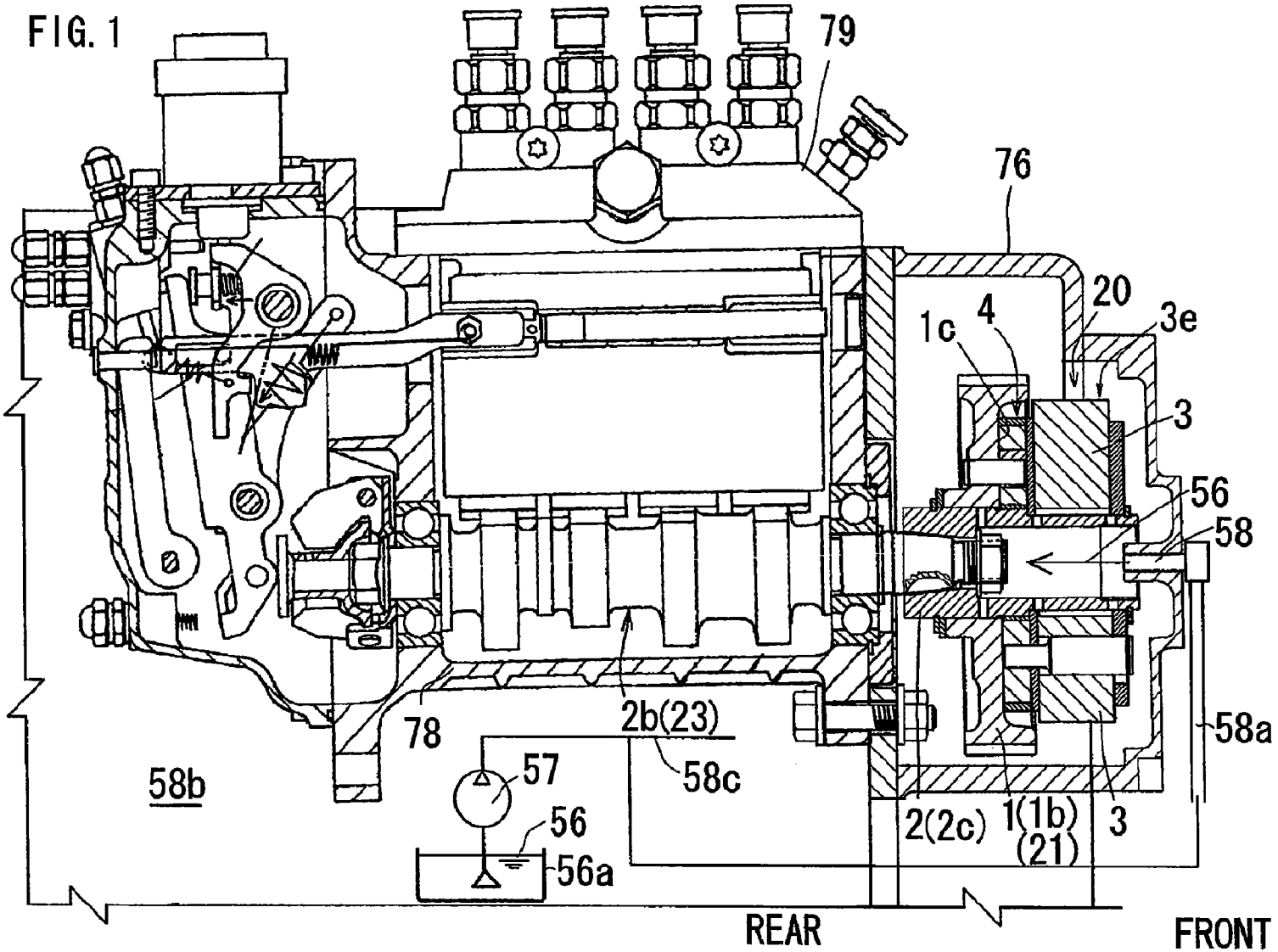
FIG. 1 is a vertical and sectional right side view of a device driving a fuel-injection pump used for an engine in accordance with a first embodiment of the present invention.
Figure 7:
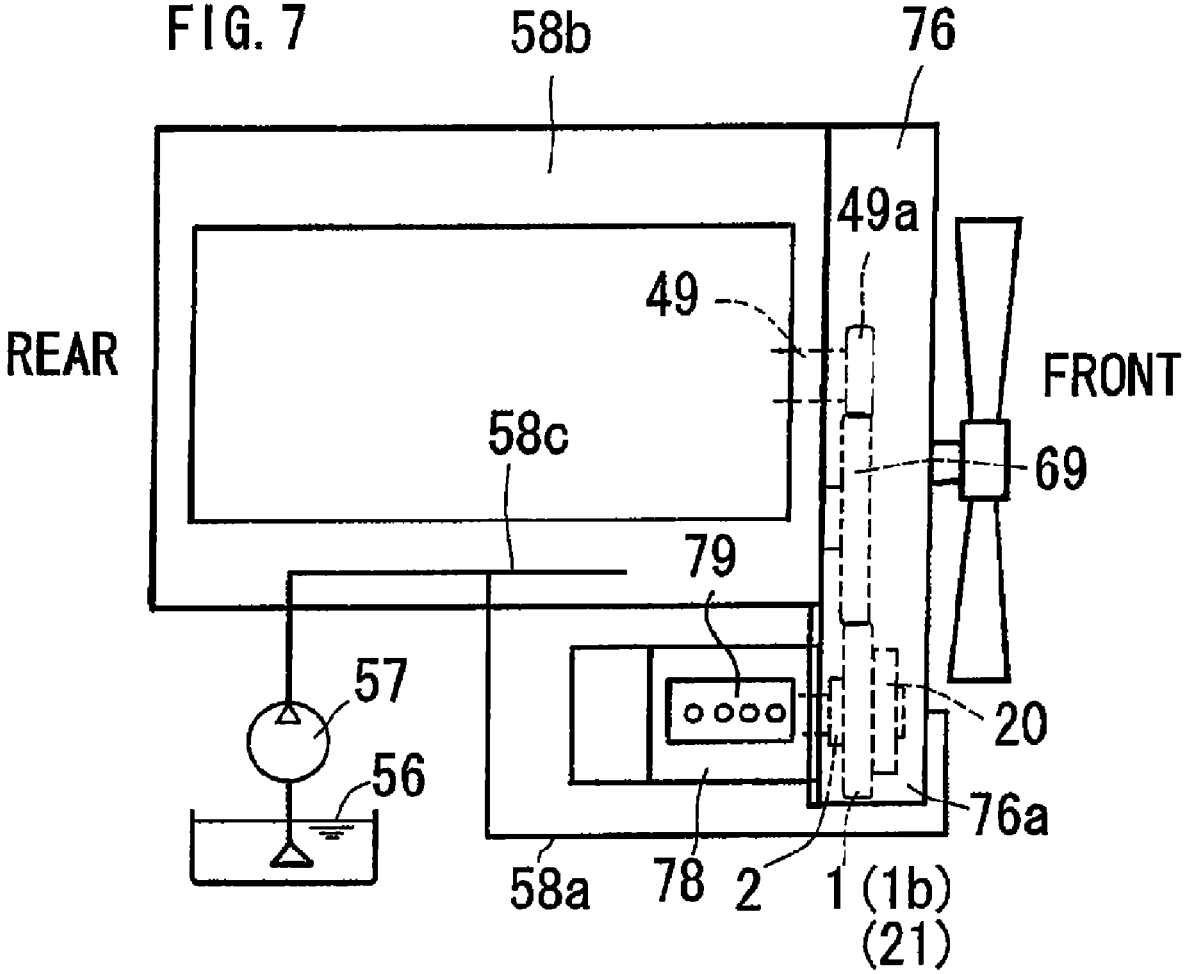
FIG. 7 is a schematic view showing a top plan view of the engine shown in FIG. 1 as a whole.

As shown in FIG. 7, a cylinder block 58*b* has a crank case within which a crank shaft 49 spans. A direction where the crank shaft 49 spans is taken as a front and rear direction and one of the direction is defined as 'front'. A gear case 76 is attached to a front portion of the cylinder block 58*b*. The gear case 76 has a lateral portion projecting further laterally than a lateral wall of the cylinder block 58*b* to form a lateral projection 76*a*. This lateral projection 76*a* has a rear surface to which a pump-containing case 78 is attached. As shown in FIG. 1, a fuel-injection pump 79 is inserted into the pump-containing case 78 from above to be accommodated in the pump-containing case 78 substantially in its entirety. The pump-containing case 78 accommodates a fuel-injection cam shaft 23 at its lower portion. The fuel-injection cam shaft 23 interlockingly operates the fuel-injection pump 79 and arranges a timer 20 at its front end portion. As shown in FIG. 7, the crank shaft 49 engages an idle gear 69 with which the fuel-injection cam gear 21 meshes.

The timer is outlined as follows.

Figures 2A, 2B, 2C:
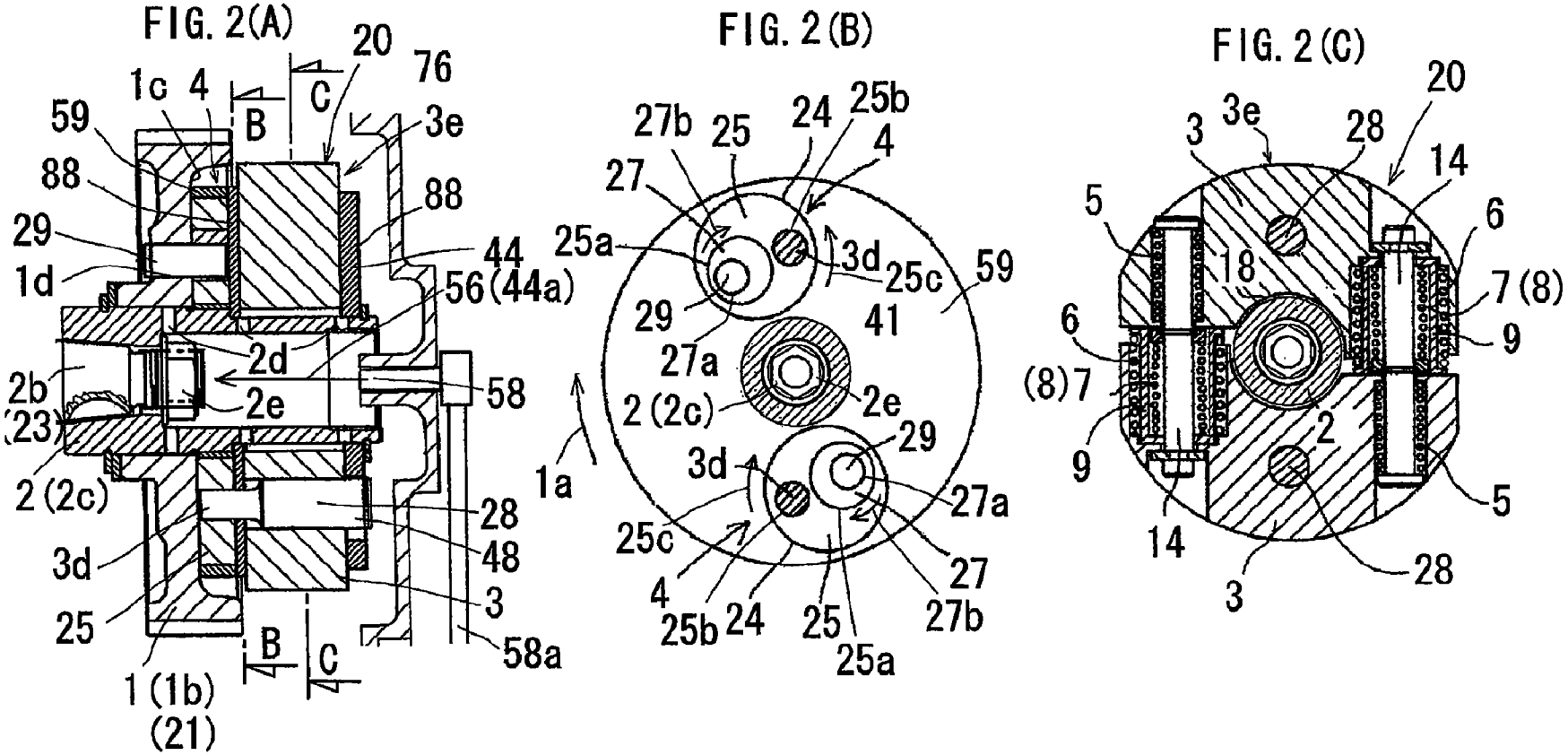
FIG. 2(A) is a vertical and sectional right side view.
FIG. 2(B) is a sectional view taken along a line B-B in FIG. 2(A) and FIG. 2(C) is a sectional view taken along a line C-C in FIG. 2(A)

As shown in FIG. 2(A) to FIG. 2(C), a downstream interlocking portion 2 is interlockingly connected through the timer 20 to an upstream interlocking portion 1 near the crank shaft 49. The timer 20 is provided with a temperature-sensing operation means 7. During a cold-starting term while the temperature-sensing operation means senses a temperature of a value less than a predetermined one, the downstream interlocking portion 2 advances by an advancing operation of the timer 20 based on an operation the temperature-sensing operation means 7 makes upon sensing the temperature. During a warm term of the engine while the temperature-sensing operation means 7 senses a temperature of a value not less than the predetermined one, an advancement of the downstream interlocking portion 2 is cancelled by an advancement-cancellation operation of the timer 20 based on another operation the temperature-sensing operation means 7 makes upon sensing the temperature.

The timer is devised as follows.

As shown in FIG. 1, an oil pump 57 for an engine oil 56 is communicated with an oil-supply port 58 through which the engine oil 56 within the engine is supplied through the oil-supply port 58 to the timer 20, so that it is brought into contact with the temperature-sensing operation means 7. The oil pump 57 sucks the engine oil 56 within an oil pan 56*a* and sends it under pressure to an oil gallery 58*c* within the cylinder block 58*b* to thereby circulate the engine oil 56 within the engine.

As shown in FIG. 1, the timer 20 is arranged within the gear case 76 and the oil-supply port 58 is provided within the gear case 76, so that the engine oil 56 supplied from the oil-supply port 58 to the timer 20 is flowed from the timer 20 into the gear case 76.

As shown in FIG. 1, the upstream interlocking portion 1 is composed of an upstream interlocking gear 1*b* and a rotary downstream portion 2 is formed from a sleeve 2*c* fixed to a rotary downstream interlocking shaft 2*b*. An axial direction of the sleeve 2*c* is taken as a front and rear direction. The timer 20 and the upstream interlocking gear 1*b* are arranged side by side in the front and rear direction, and are externally fitted onto the sleeve 2*c* as they are. This upstream interlocking gear 1*b* is a fuel-injection cam gear 21.

As illustrated in FIG. 1, the upstream interlocking gear 1*b* has a front and a rear surfaces one of which is provided with a recess portion 1*c*. This recess portion 1*c* accommodates at least part of the timer 20. Concretely, the recess portion 1*c* is formed in a front surface of the upstream interlocking gear 1*b* and accommodates an eccentric cam mechanism 4 at a rear portion of the timer 20.

As shown in FIG. 2(A) to FIG. 2(C), the temperature-sensing operation means 7 is composed of a shape-memory spring 8 and the timer 20 is formed from a cam interlocking portion 3*e* and the eccentric cam mechanism 4. The eccentric cam mechanism 4 comprises disk cams 25 and 27 attached to a cam holder 59 and interlockingly connected through a cam interlocking portion 3*e* to the shape-memory spring 8. And it performs the advancing operation of the timer 20 and the advancement-cancellation operation thereof based on the extending and contracting deformation of the shape-memory spring 8.

As shown in FIG. 2(A) to FIG. 2(C), the oil-supply port 58 is arranged opposite to an interior area of the sleeve 2*c* and the sleeve 2*c* has a peripheral wall provided with an oil flow-out port 2*d*. The engine oil 56 is injected from the oil-supply port 58 into the sleeve 2*c*. The engine oil 56 is flowed out of the oil flow-out port 2*d* and is supplied to the timer 20 so as to be brought into contact with the temperature-sensing operation means 7.

As shown in FIG. 2(A) to FIG. 2(C), the timer 20 is composed of the cam interlocking portion 3*e* and the eccentric cam mechanism 4. The cam interlocking portion 3*e* comprises a pair of centrifugal weights 3 and 3, which are positioned along guide plates 88 and 88. The eccentric cam mechanism 4 comprises the disk cams 25 and 27 attached to the cam holder 59. These disk cams 25 and 27 are interlockingly connected through the cam interlocking portion 3*e* to the temperature-sensing operation means 7. In order to perform the advancing operation and the advancement-cancellation operation of the timer 20 based on the operation that the temperature-sensing operation means 7 makes upon sensing a temperature, the following arrangement is made.

The engine oil 56 flowed out of the oil flow-out port 2*d* and fed to the timer 20 is also supplied to between the centrifugal weight 3 and the guide plate 88.

As shown in FIG. 1, an oil-supply port 8 is arranged in a wall of the gear case 76.

As shown in FIG. 1, an engine's wall is provided on its outer side with an external piping 58*a*, which communicates the oil gallery 58*c* within the cylinder block 58*b* with the oil-supply port 58 of the gear case 76.

As shown in FIG. 2(A), in order to fix the sleeve 2*c* to the downstream interlocking rotary shaft 2*b* by a fastening member 2*e*, the sleeve 2*c* contains the fastening member 2*e*.

The eccentric cam mechanism has the following structure.

As shown in FIG. 2(B), the cam holder 59 is opened to provide a pair of larger-diameter cam holes 24, 24, into which larger-diameter disk cams 25 are internally fitted. Each of the larger-diameter disk cams 25 is opened to provide a smaller-diameter cam hole 25*a* and a pin hole 25*b*. A smaller-diameter disk cam 27 is internally fitted into every smaller-diameter cam hole 25*a*. Each of the centrifugal weights 3 projects an output pin 3*d* which is internally fitted into the pin hole 25*b*. Each of the smaller-diameter disk cams 27 is opened to provide a pin hole 27*a* into which a pin 29 is internally fitted. As shown in FIG. 2(A), this pin 29 is internally fitted into the pin hole 1*d* of the upstream interlocking portion 1.

A degree of advancement is adjusted by the operation of the eccentric cam mechanism as follows.

A force of unbalance between a centrifugal force of each of the centrifugal weights 3 and a biasing force of a weight-return spring 5 operates the respective centrifugal weights 3 to move them in a centrifugal direction. This advances the downstream interlocking portion 2 with respect to the upstream interlocking portion 1 through the eccentric cam mechanism 4. When the respective centrifugal weights 3 are moved in a centripetal direction, the downstream interlocking portion 2 is made to lag with respect to the upstream interlocking portion 1 through the eccentric cam mechanism 4. Concretely, as shown in FIG. 2(B), when the respective centrifugal weights 3 are moved in the centrifugal direction to displace the output pin 3*d* from each of the centrifugal weights 3 in the centrifugal direction, the larger-diameter disk 25 is rotated in a direction indicated by an arrow 25*c* and the smaller-diameter disk 27 is rotated in a direction indicated by an arrow 27*b*. This widens a spacing between the output pin 3*d* and the pin 29, thereby shifting the output pin 3*d* toward a downstream side of a rotation direction 1*a* of the upstream interlocking portion 1 and the downstream interlocking portion 2 toward the downstream side of the rotation direction 1*a* with respect to the upstream interlocking portion 1. Therefore, the downstream interlocking portion 2 advances with respect to the downstream interlocking portion 1. When the respective centrifugal weights 3 are moved in the centripetal direction to displace the output pin 3*d* from each of the centrifugal weights 3 in the centripetal direction, the larger-diameter disk 25 is rotated in a direction opposite to the above-mentioned one as well as the smaller-diameter disk 27. Accordingly, the output pin 3*d* of the centrifugal weight 3 is shifted toward an upstream side of the rotation direction 1*a* of the upstream interlocking portion 1 and the downstream interlocking portion 2 is shifted toward the upstream side of the rotation direction 1*a* with respect to the upstream interlocking portion 1, thereby allowing the downstream interlocking portion 2 to lag with respect to the upstream interlocking portion 1. Therefore, the engine rotates at an increased speed to increase the centrifugal force of each of the centrifugal weights 3. Then the fuel-injection cam shaft 23 advances to accelerate the timing for fuel-injection. On the other hand, when the engine rotates at a decreased speed to decrease the centrifugal force of each of the centrifugal weights 3, the fuel injection cam shaft 23 lags to delay the timing for fuel-injection.

The structure for obtaining the advancement on starting an engine is as follows.

Figure 3D:
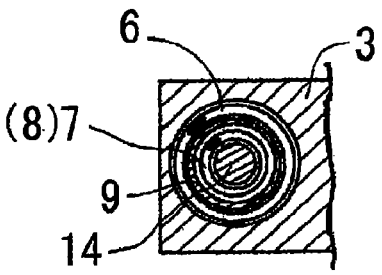
FIG. 3(D) is a sectional view taken along a line D-D of FIG. 3(A).
Figure 3B:
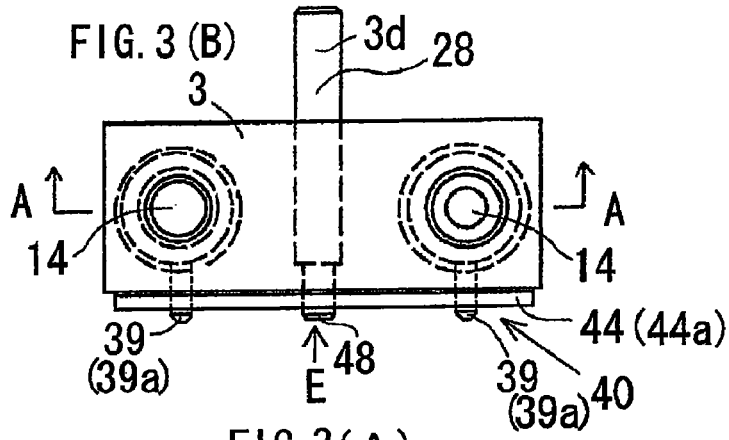
FIG. 3(B) is a top plan view.
Figure 3C:
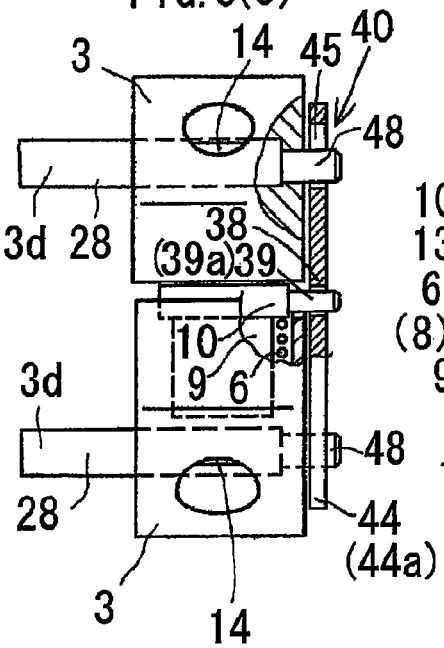
FIG. 3(C) is a partly cut side view.
Figure 3A:
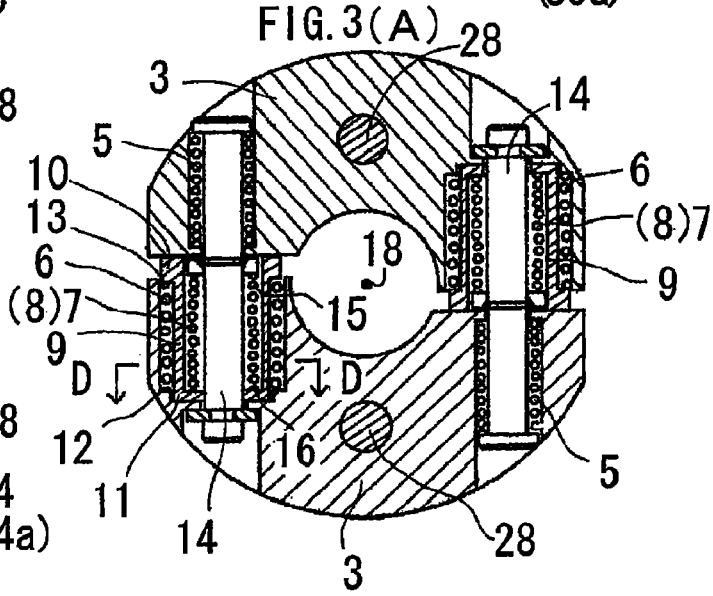
FIG. 3(A) is a vertical sectional view taken along a line A-A in FIG. 3(B).
Figure 4A:
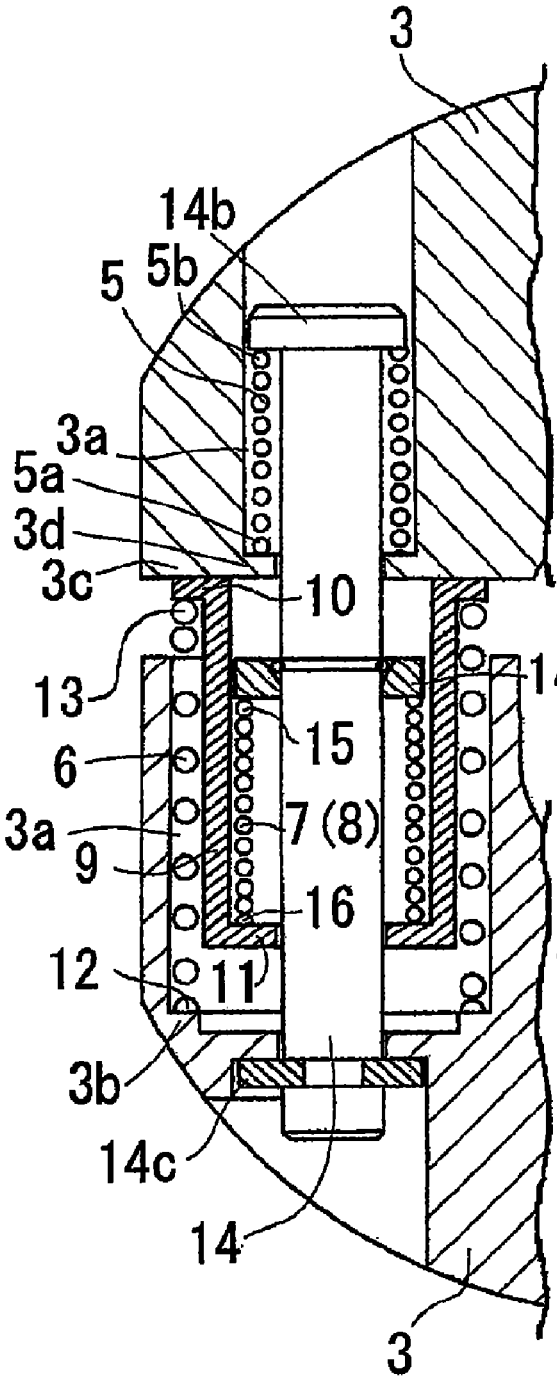
FIG. 4(A) shows an operation state when starting the engine during the cold term.
Figure 4B:
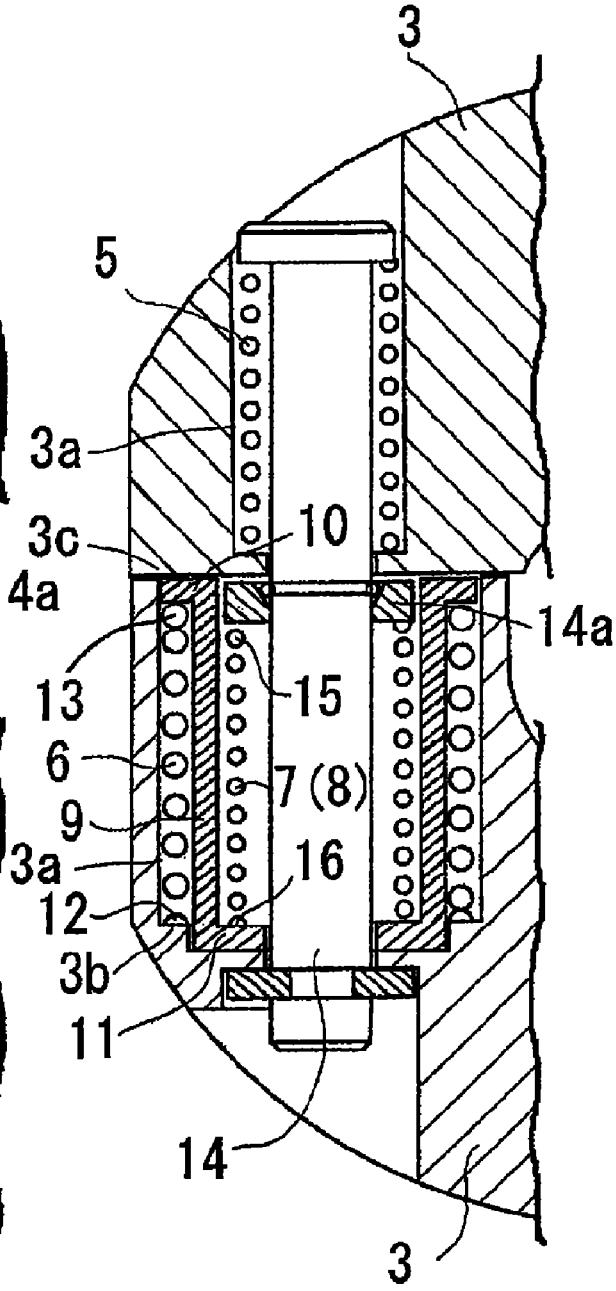
FIG. 4(B) shows another operation state while the engine is warm.
Figure 5:
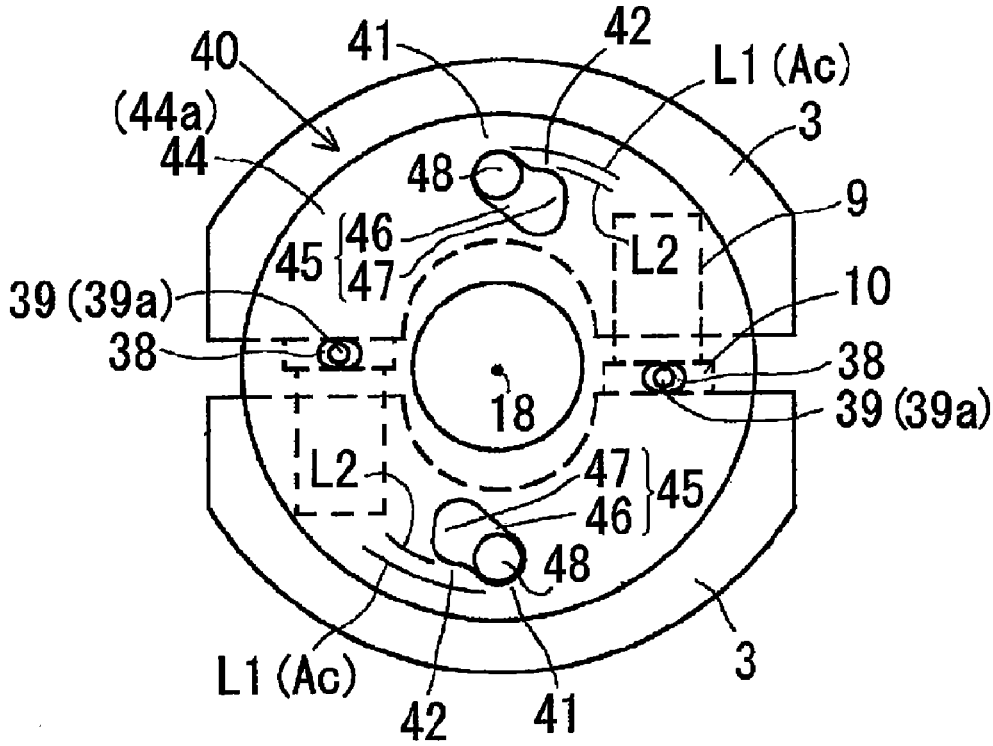
FIG. 5 shows an advancement limiting state of the timer shown in FIG. 2.
Figure 5:
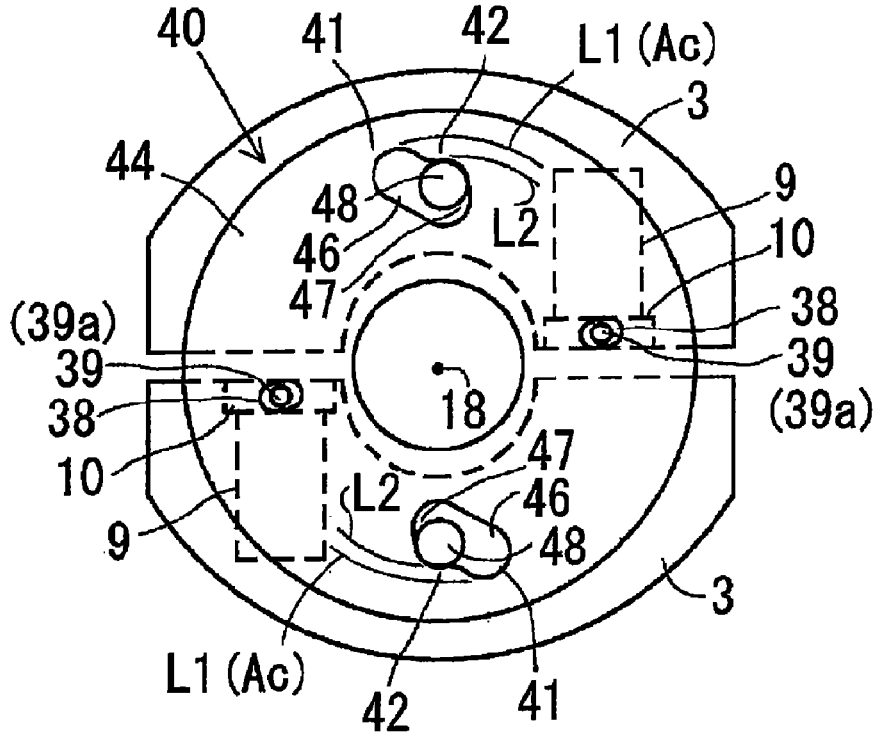
Figure 6A:
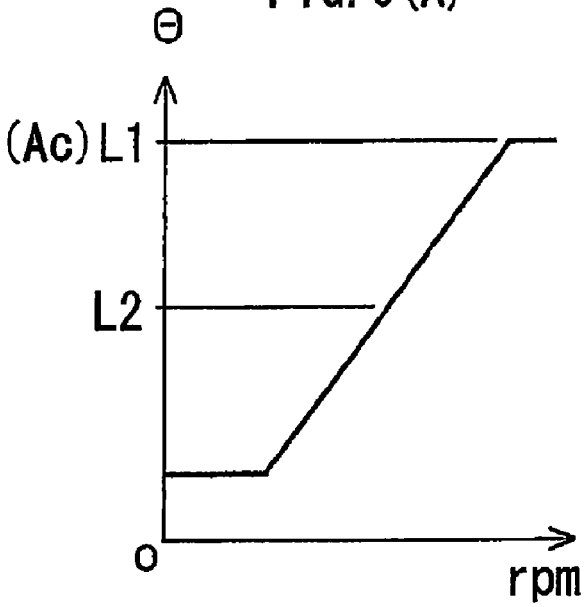
FIG. 6(A) shows a state when starting the engine during the cold term.
Figure 6B:
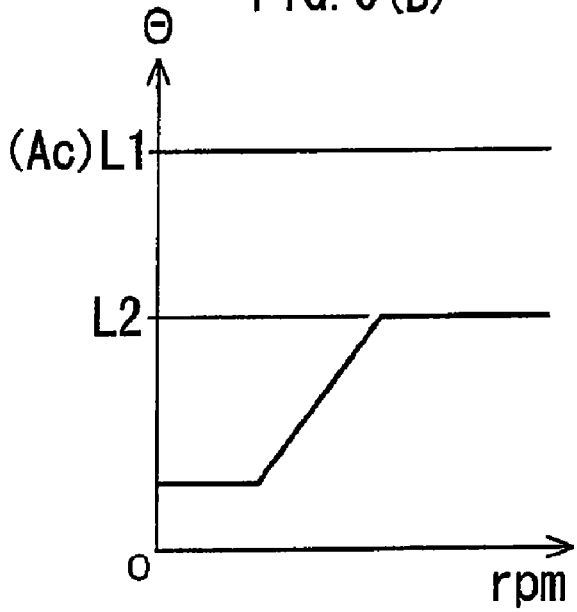
FIG. 6(B) shows another state while the engine is warm.

As shown in FIG. 3(A), each of the centrifugal weights 3 is interlockingly connected to an advancing spring 6 composed of a compression-coil spring. This advancing spring 6 is interlockingly connected to the temperature-sensing operation means 7. As shown in FIG. 4(A), when starting the engine during a cold term, the advancing spring 6 is maintained extensible based on a state (contracted state) of the temperature-sensing operation means 7 in which the temperature-sensing operation means 7 senses a temperature to operate. This advancing spring 6 exerts a spring force which pushes and widens the pair of centrifugal weights 3, 3 to an advancing position (Ac) for cold-starting the engine. As shown in FIG. 4(B), while the engine is warm, the advancing spring 6 is held contracted based on another state (extensible state) of the temperature-sensing operation means 7 in which the temperature-sensing operation means 7 senses a temperature to operate, so that the spring force of the advancing spring 6 does not act on the pair of centrifugal weights 3, 3. The warm term of the engine means a term during which the engine is in operation or the engine starts while it is warm.

The temperature-sensing operation means is constructed as follows.

As shown in FIG. 3(A), the shape-memory spring 8 composed of a compression-coil spring is used for the temperature-sensing operation means 7. This shape-memory spring 8 and the advancing spring 6 are interposed between the pair of centrifugal weights 3, 3 in a position concentric with the weight-return spring 5. As for the shape-memory spring 8 to be used, it is made of a shape-memory alloy and has a property of contracting when the engine is started during the cold term and of extending while the engine is warm.

The arrangement of the shape-memory spring and the like is outlined as follows.

As shown in FIG. 3(A), one of the paired centrifugal weights 3, 3 has an interior area formed with a spring-accommodating hole 3*a* which accommodates the weight-return spring 5 and the other of the paired centrifugal weights 3, 3 has an interior area provided with a spring-accommodating hole 3*a* which accommodates the advancing spring 6 and the shape-memory spring 8. The shape-memory spring 8 and the advancing spring 6 are formed into a double structure where one of them is positioned inside and the other is arranged outside.

The arrangement of the shape-memory spring and the like is recited in detail as follows.

As shown in FIGS. 4(A) and 4(B), the spring-accommodating hole 3*a* of one centrifugal weight 3 which accommodates the advancing spring 6 has an inner bottom provided with a first spring seat 3*b*, on which the advancing spring 6 has its base end portion 12 seated. A transmission cylinder 9 is arranged concentrically within this advancing spring 6. The transmission cylinder 9 has a leading end portion near a leading end portion 13 of the advancing spring 6. A first spring retainer 10 is provided at this leading end portion of the transmission cylinder 9 outwardly. This first spring retainer 10 receives the leading end portion 13 of the advancing spring 6 and is brought into contact with a retainer-receiving surface 3*c* of the centrifugal weight 3 which accommodates the weight-return spring 5.

An axis 14 is attached to the centrifugal weight 3 which accommodates the advancing spring 6. This axis 14 is arranged concentrically within the transmission cylinder 9 and is provided with a second spring seat 14*a*, on which the shape-memory spring 8 has its base end portion 15 seated. This shape-memory spring 8 is arranged concentrically between the axis 14 and the transmission cylinder 9. The transmission cylinder 9 has another leading end portion close to a leading end portion 16 of the shape-memory spring 8. A second spring retainer 11 is provided at this another leading end portion of the transmission cylinder 9 inwardly. This second spring retainer 11 receives the leading end portion 16 of the shape-memory spring 8. The aforesaid axis 14 is a guide axis to open and close the pair of centrifugal weights 3, 3 and is inserted into the spring-accommodating hole 3*a* which accommodates the weight-return spring 5. This spring-accommodating hole 3*a* has an inner bottom provided with a third spring seat 3*d*, on which the weight-return spring 5 has its base end portion 5*a* seated. This weight-return spring 5 is concentrically arranged outside the axis 14. This axis 14 has a leading end provided with a third spring retainer 14*b*. This third spring retainer 14*b* receives a leading end portion 5*b* of the weight-return spring 5. The axis 14 has a base end portion provided with a washer 14*c* which is brought into contact with the centrifugal weight 3 on the side of the advancing spring 6 so as to prevent the axis 14 from being dismantled by the spring force of the weight-return spring 5.

As shown in FIG. 4(A), when starting the engine during the cold term, the advancing spring 6 is maintained extensible based on the sate of the contracted shape-memory spring 8, in which the shape-memory spring 8 senses a temperature to operate, and has its spring force act on the first spring seat 3*b* and the retainer-receiving surface 3*c*, thereby enabling the paired centrifugal weights 3, 3 to be pushed and widened to the advancing position (Ac).

As shown in FIG. 4(B), when starting the engine during the warm term, the advancing spring 6 is held contracted based on another state of the extended shape-memory spring 8, in which the shape-memory spring 8 senses a temperature to operate, so that the spring force of the advancing spring 6 does not act on the first spring seat 3*b* and the retainer-receiving surface 3*c*.

The structure for switching over an upper limit of the degree of the advancement is outlined as follows.

Figure 3E:
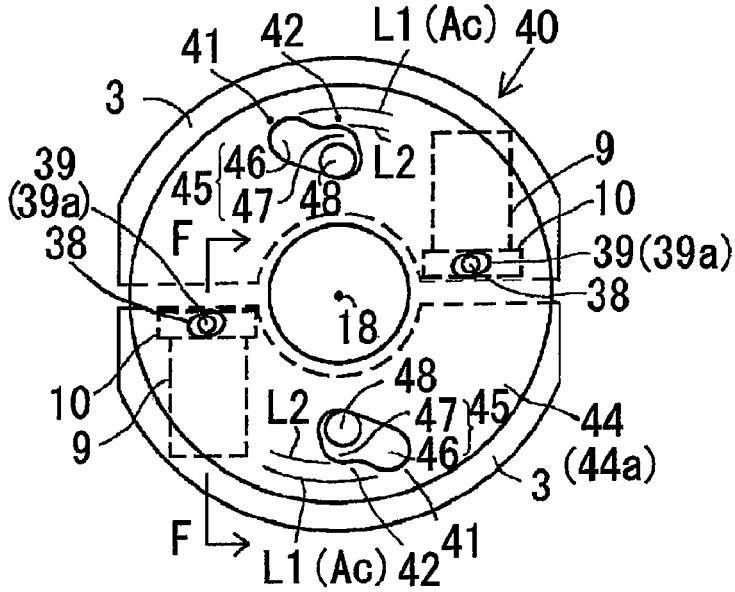
FIG. 3(E) is a view when seen in a direction indicated by an arrow (E) in FIG. 3(B).

As shown in FIG. 3(E), a first limiting member of advancement 41 and a second limiting member of advancement 42 are interlockingly connected to the shape-memory spring 8 through an output means 39 and a limitation switch-over means 44 so that they can be switched over.

As shown in FIG. 5(A), when starting the engine during the cold term, the first limiting member of advancement 41 is arranged so that it can make limitation based on the state (contracted state) of the shape-memory spring 8, in which the shape-memory spring 8 senses a temperature to operate, through the output means 39 and the limitation switch-over means 44. This first limiting member of advancement 41 confines an upper limit of the movement of every centrifugal weight 3 in the centrifugal direction to a first limiting position of advancement (L1).

As shown in FIG. 5(B), while the engine is warm, the second limiting member of advancement 42 is arranged so that it can make limitation based on another state (extensible state) of the shape-memory spring 8, in which the shape-memory spring 8 senses a temperature to operate, through the output means 39 and the limitation switch-over means 44. This second limiting member of advancement 42 confines the upper limit of the movement of every centrifugal weight 3 in the centrifugal direction to a second limiting position of advancement (L2).

The second limiting position of advancement (L2) lowers the upper limit of the movement of every centrifugal weight 3 in the centrifugal direction so as to make an upper limit of a degree of advancement (θ) lower when compared with the first limiting position of advancement (L1).

This second limiting position of advancement (L2) comes to be the advancing position (Ac) for cold-starting the engine.

The structure for switching over the upper limit of the degree of advancement is described in detail as follows.

As shown in FIG. 3(E), a rotating plate 44*a* is utilized for an alternative switch-over means 44. The rotating plate 44*a* is provided at one lateral portion of the paired centrifugal weights 3, 3 and is made rotatable around a center line 18 of rotation of the downstream interlocking portion 2.

The rotating plate 44*a* is opened to provided a first limiting hole of advancement 46 and a second limiting hole of advancement 47. The first and second limiting holes of advancement 46 and 47 are arranged side by side in a rotation direction of the centrifugal weight 3 and are communicated with each other to form a communication hole 45.

The first limiting hole of advancement 46 has a peripheral edge portion on a centrifugal side, which forms the first limiting member of advancement 41 and the second limiting hole of advancement 47 has a peripheral edge portion on the centrifugal side, which forms the second limiting member of advancement 42. Each of the centrifugal weights 3, 3 projects an engaging projection 48 into the communication hole 45.

As shown in FIG. 5(A), when starting the engine during the cold term, the rotating plate 44*a* is placed in a first rotating position based on the state (contracted state) of the shape-memory spring 8 in which the shape-memory spring 8 senses a temperature to operate. The first limiting member of advancement 41 can receive the engaging projection 48.

As shown in FIG. 5(B), while the engine is warm, the rotating plate 44*a* is placed in a second rotating position based on another state (extensible state) of the shape-memory spring 8 in which the shape-memory spring 8 senses a temperature to operate. The second limiting member of advancement 42 can receive the engaging projection 48.

Other devices are as follows.

Figure 3F:
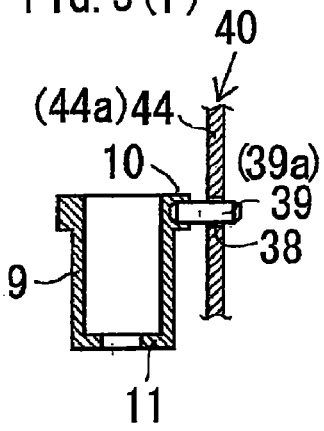
FIG. 3(F) is a sectional view taken along a line F-F in FIG. 3(E)

As shown in FIG. 2(A), while the rotating plate 44*a* is provided at one lateral portion of the paired centrifugal weights 3, 3, the eccentric cam mechanism 4 is arranged at the other lateral portion thereof. A pin 28 passes through each of the centrifugal weights 3. This pin 28 has one end portion which serves as the engaging projection 48 and has the other end portion which serves as the output pin 3*d* extending from every centrifugal weight 3 to the eccentric cam mechanism 4. As shown in FIG. 3(F), an output pin 39*a* is employed for the output means 39 from the shape-memory spring 8. The rotating plate 44 is opened to provide an engaging hole 38 with which the output pin 39*a* engages. The output pin 39*a* is attached to the first spring retainer 10.

The second embodiment of the present invention has the following construction.

Figures 8A, 8B:
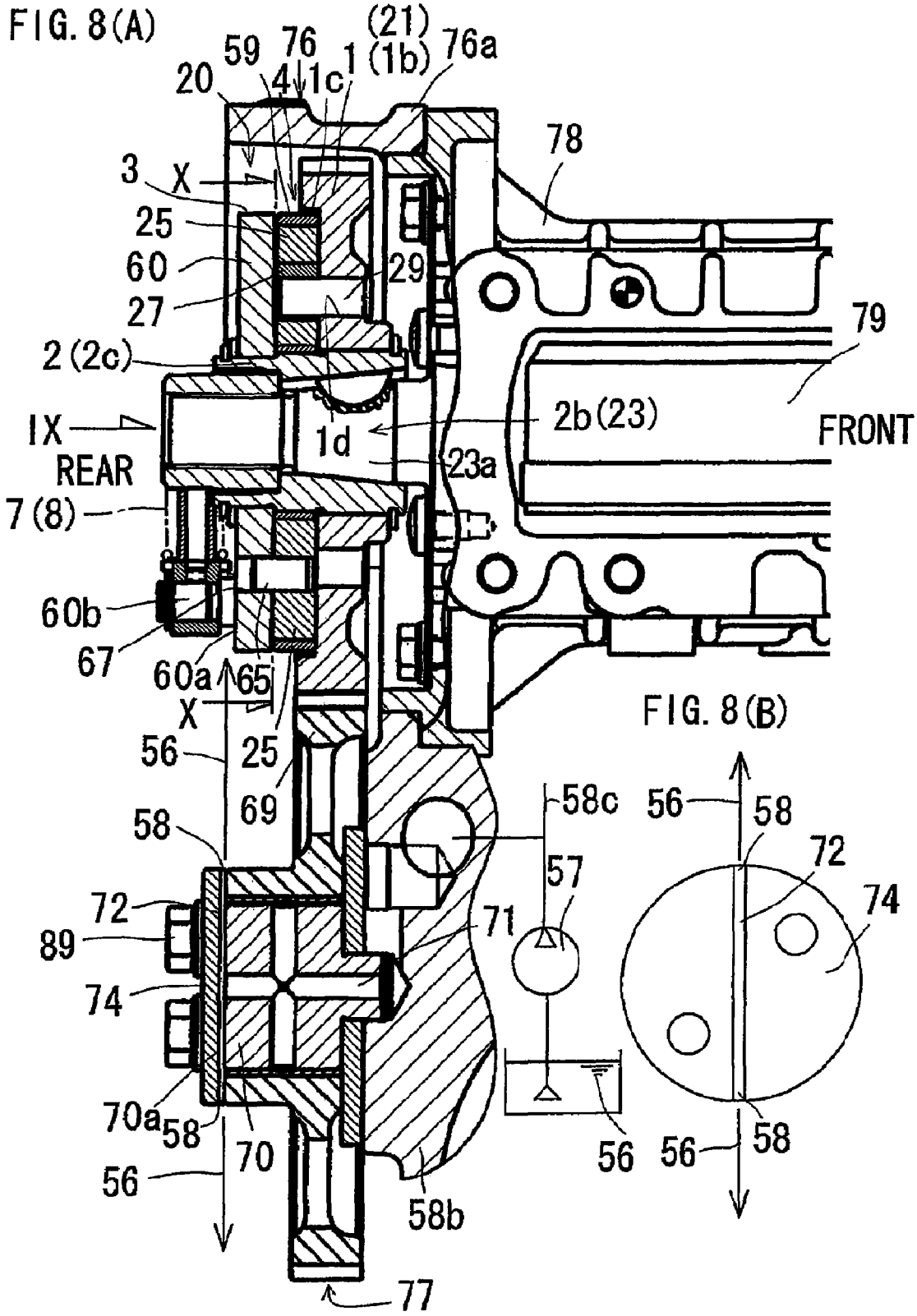
FIG. 8 is a view explaining essential portions of an engine in accordance with a second embodiment of the present invention.

As shown in FIG. 8(A), the direction where the crank shaft spans is taken as the front and rear direction. One of the direction is determined as 'front' and the other is defines as 'rear'. The gear case 76 is arranged at a rear portion of the cylinder block 58*b*. This gear case 76 accommodates a gear train 77. The gear case 76 has a lateral end portion projected further laterally from a lateral wall of the cylinder block 58*b* to provide a lateral projection 76*a*. The lateral projection 76*a* has a front surface to which a pump-containing case 78 is attached. This pump-containing case 78 contains a fuel-injection pump 79. A fuel-injection cam shaft 23 spans below the fuel-injection pump 79 within the pump-containing case 78. This engine is equipped with the timer 20.

The timer is outlined as follows.

As shown in FIG. 8(A), the downstream interlocking portion 2 is interlockingly connected through the timer 20 to the upstream interlocking portion 1 near the crank shaft 49. The timer 20 is provided with the temperature-sensing operation means 7. During the cold-starting term while the temperature-sensing operation means senses a temperature of a value less than a predetermined one (for example less than 0 degrees C.), the downstream interlocking portion 2 advances by an advancing operation of the timer 20 based on an operation the temperature-sensing operation means 7 makes upon sensing the temperature. During a warm-term of the engine while the temperature-sensing operation means 7 senses a temperature of a value not less than the predetermined one (for example not less than 0 degrees C.), an advancement of the downstream interlocking portion 2 is cancelled by an advancement-cancellation operation of the timer 20 based on another operation the temperature-sensing operation means 7 makes upon sensing the temperature. Also in this second embodiment, the upper interlocking portion 1 is a fuel-injection cam gear 21 and the downstream interlocking portion is a sleeve 2*c*.

The timer is devised as follows.

As shown in FIG. 8(A), the oil pump 57 sends under pressure the engine oil 56 which is circulated within the engine. The oil pump 57 is communicated with the oil-supply port 58 through which the engine oil 56 is supplied to the timer 20, so that it is brought into contact with the temperature-sensing operation means 7.

As shown in FIG. 8(A), the timer 20 is arranged within the gear case 76 and the oil-supply port 58 is opened into the gear case 76, so that the engine oil 56 supplied from the oil-supply port 58 to the timer 20 is flowed into the gear case 76. The oil-supply port 58 is an oil-injection port through which the engine oil 56 is injected to the timer 20.

As shown in FIG. 8(A), the upstream interlocking portion 1 is composed of an upstream interlocking gear 1*b* and a rotary downstream portion 2 is formed from a sleeve 2*c* fixed to a rotary downstream interlocking shaft 2*b*. An axial direction of the sleeve 2*c* is taken as a front and rear direction. The timer 20 and the upstream interlocking gear 1*b* are arranged side by side in the front and rear direction, and are externally fitted onto the sleeve 2*c* as they are.

As illustrated in FIG. 8(A), the upstream interlocking gear 1*b* has a front and a rear surfaces one of which is provided with a recess portion 1*c*. This recess portion 1*c* accommodates at least part of the timer 20. Concretely, the recess portion 1*c* is formed in a rear surface of the upstream interlocking gear 1*b* and accommodates an eccentric cam mechanism 4 at a front portion of the timer 20.

The timer has the following concrete structure.

Figure 9A:
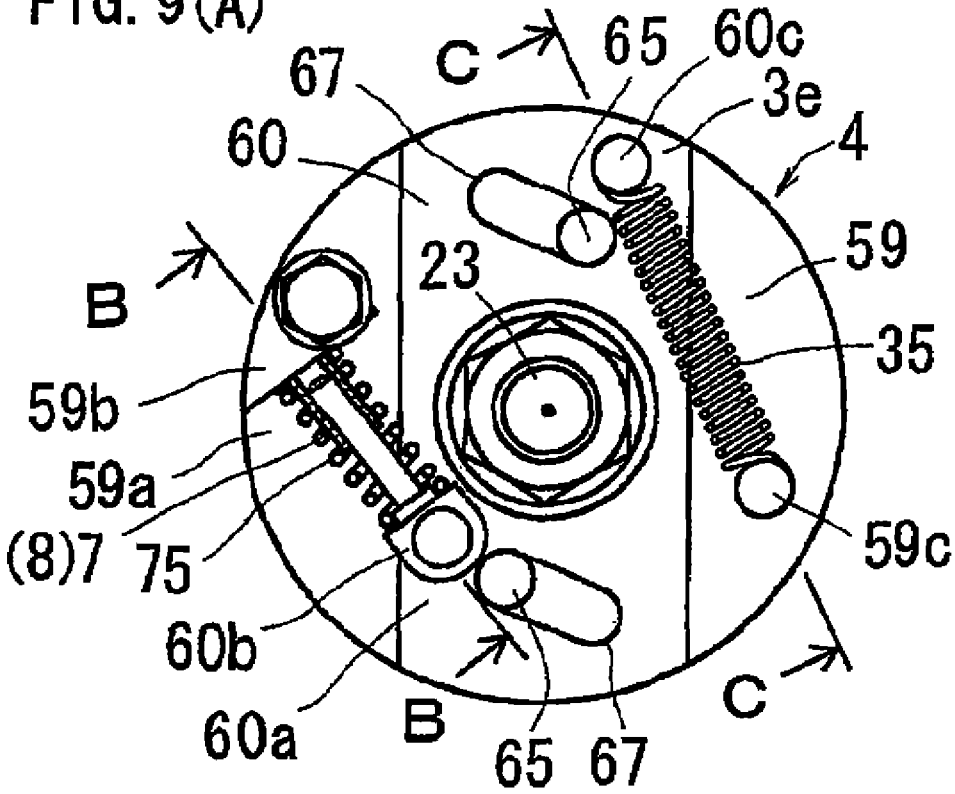
FIG. 9(A) is a view when seen in a direction indicated by an arrow IX in FIG. 8(A)
Figure 9B:
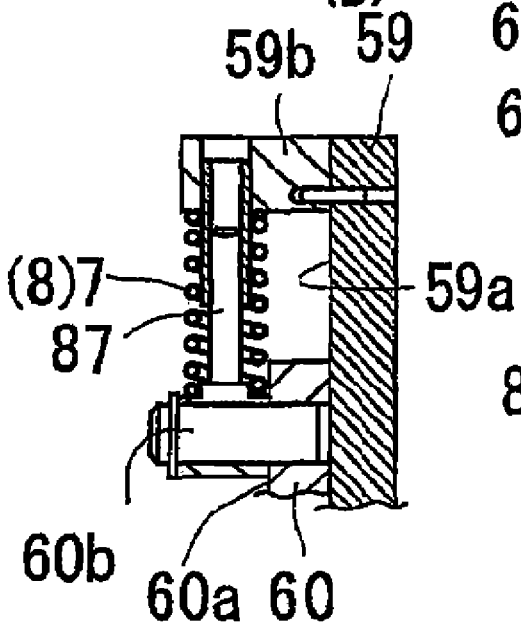
FIG. 9(B) is a sectional view taken along a line B-B in FIG. 9(A) and FIG. 9(C) is a sectional view taken along a line C-C in FIG. 9(A)
Figure 9C:
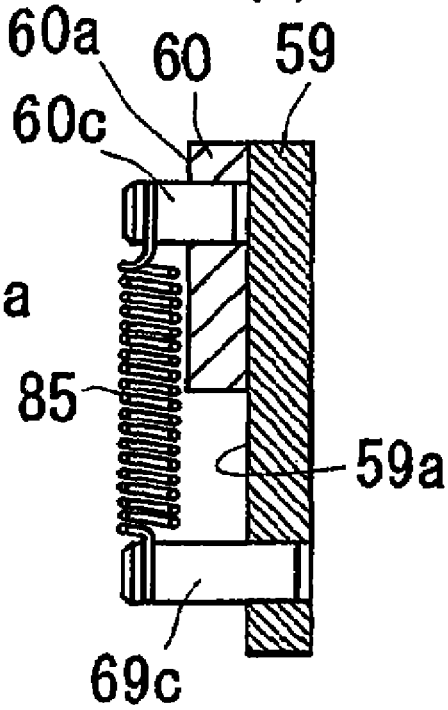

As shown in FIG. 8(A), the timer 20 is composed of the eccentric cam mechanism 4. The fuel-injection cam gear 21, a cam holder 59 and a cam driving plate 60 are attached as they are superposed one on another to a rear end portion 23*a* of a fuel-injection cam shat 23 in the mentioned order from the front. As shown in FIGS. 9(A) and 9(B), the cam holder 59 has a rear end surface 59*a* disclosed laterally of the cam driving plate 60. A rear end surface 60*a* of the cam driving plate 60 and the rear end surface 59*a* of the cam holder 59 provides a pair of support portions 60*b* and 59*b* so as to project therefrom. The temperature-sensing operation means 7 is arranged between the pair of support portions 60*b* and 59*b* as it is exposed. The temperature-sensing operation means 7 is a push spring made of a shape-memory alloy, namely a shape-memory spring 8. As shown in FIGS. 9(A) and 9(B), an extending and contracting rod 87 which spans between the paired support portion 60*b* and 59*b* is inserted into the temperature-sensing operation means 7 so as to prevent the temperature-sensing operation means 7 from falling down. As illustrated in FIGS. 9(A) and 9(C), the cam holder 59 has the rear end surface 59*a* disclosed laterally of the cam driving plate 60. The rear end surface 60*a* of the cam driving plate 60 and the rear end surface 59*a* of the cam holder 59 provides another pair of support portions 60*c* and 59*c* so as to project therefrom. A return spring 85 of a pull-spring type spans between another pair of support portions 60*c* and 59*c*. As shown in FIG. 8(A), the sleeve 2*c* is attached irrotatable to the rear end portion 23*a* of the fuel-injection cam shaft 23. The fuel-injection cam gear 21 and the cam driving plate 60 are attached rotatable to the sleeve 2*c* while the cam holder 59 is attached irrotatable to the sleeve 2*c*.

Figure 10:
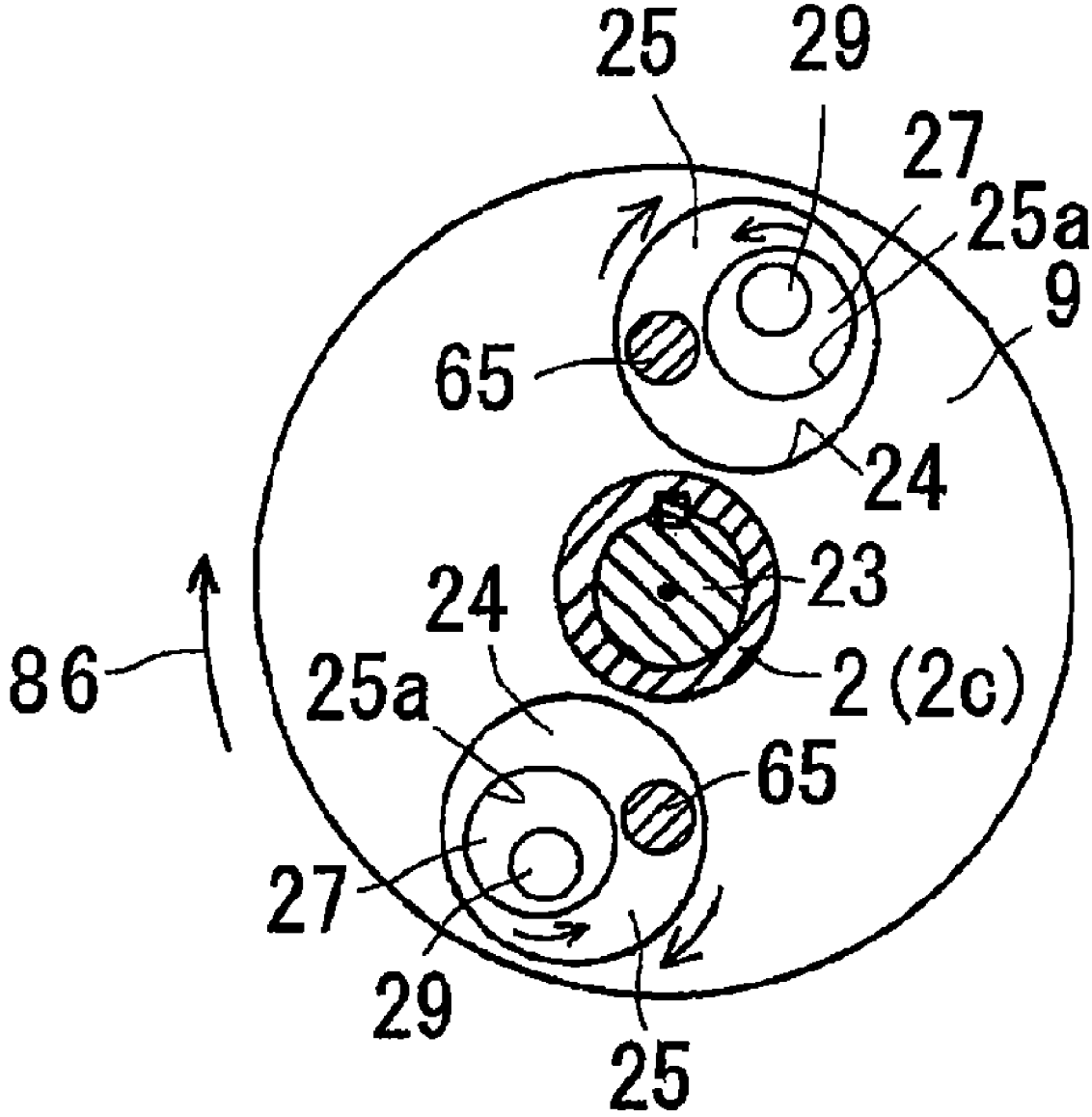
FIG. 10 is a sectional view taken along a line X-X in FIG. 8(A) and explains how an eccentric cam mechanism operates.
Figure 11:
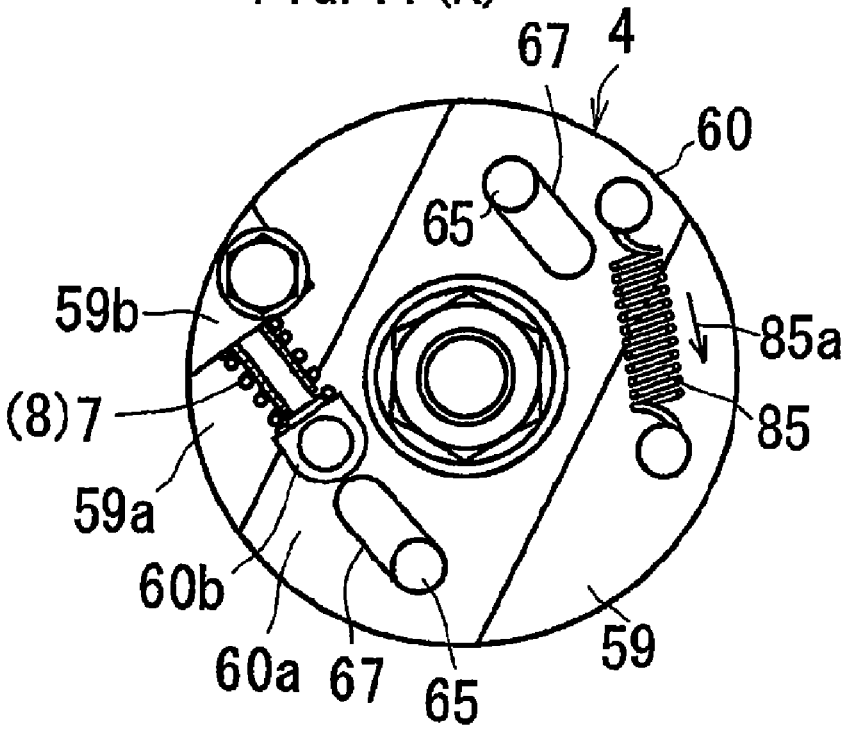
FIG. 11 is a view explaining how the timer used for the engine shown in FIG. 8 operates.
Figure 11:
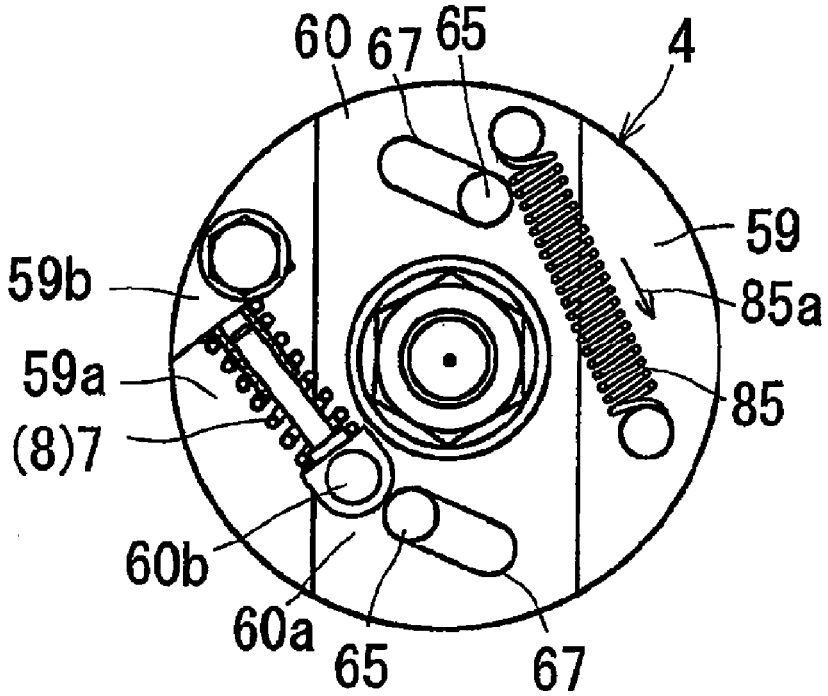

As shown in FIG. 10, the cam holder 59 is opened to provide a pair of circular larger-diameter cam holes 24, 24, into which larger-diameter disk cams 25, 25 are rotatably internally fitted. Each of the larger-diameter disk cams 25 is opened to provide a smaller-diameter cam hole 25*a*. A smaller-diameter disk cam 27 is rotatably internally fitted into every smaller-diameter cam hole 25*a*. An input pin 65 is attached to each of the larger-diameter disk cams 25, 25. The guide driving plate 60 is provided with guide holes 67, 67 into which the input pins 65, 65 are internally fitted. Attached to the smaller-diameter disk cams 27, 27 are output pins 29, 29, which are internally fitted into the pin holes 1*d*, 1*d* of the fuel-injection cam gear 23. The guide holes 67, 67 are inclined with respect to a rotation direction of the cam driving plate 60.

The timer performs the advancing operation and the advancement-cancellation operation as followed.

As shown in FIG. 11(A), during the cold-starting, the temperature-sensing operation means 7 senses a temperature of a value less than a predetermined one and therefore is contracted. The cam driving plate 60 retains a position for the advancing operation by a spring force 85*a* of the return spring 85 and the input pins 65, 65 are positioned at the respective outward end portions of the guide holes 67, 67. The timer 20 is in the state of the advancing operation. After the cold-starting, the engine oil 56, the temperature of which promptly increases, is injected to the timer 20, so that the temperature-increase of the engine is immediately transmitted to the temperature-sensing operation means 7, thereby enabling the temperature-sensing operation means 7 to sense a temperature of a value not less than the predetermined one. Then, as shown in FIG. 11(B), the temperature-sensing operation means 7 extends, thereby allowing the cam driving plate 60 to come to a position for the advancement-cancellation against the spring force 85*a* of the return spring 85. As a result, the input pins 65, 65 are positioned at inward end positions of the guide holes 67, 67 and the timer 20 comes to the advancement-cancellation state.

The eccentric rotary cam mechanism operates as follows.

As shown in FIG. 11(A), in the case where the temperature-sensing operation means 7 senses a temperature of a value less than the predetermined one, the cam driving plate 60 rotates to push the input pins 65, 65 outwardly. In this case, as shown in FIG. 10, when the cam holder 59 is seen from the rear, the larger-diameter disk cams 25, 25 rotate in a clockwise direction while the smaller-diameter disk cams 27, 27 rotates in a counter-clockwise direction. A phase of the input pins 65, 65 is shifted to a downstream side of a rotation direction 86 of the fuel-injection cam shaft 23 to thereby advance the fuel-injection cam shaft 23. As shown in FIG. 11(B), in the case where the temperature-sensing operation means 7 senses a temperature of a value not less than the predetermined one, the cam driving plate 60 rotates to push the input pins 65, 65 inwardly. In this case, contrary to the case shown in FIG. 10, the larger-diameter disk cams 25, 25 rotate in the counter-clockwise direction while the smaller-diameter disk cams 27, 27 rotate in the clockwise direction. The phase of the input pins 65, 65 is shifted to an upstream side of the rotation direction 86 of the fuel-injection cam shaft 23 to cancel the advancement of the fuel-injection cam shaft 23.

Other devices are as follows.

As shown in FIG. 8(A), a fuel-injection cam gear 21 engages with an idle gear 69. The idle gear 69 has a pivot axis 70 provided with an oil-supply passage 71 that supplies the engine oil 56 to between the idle gear 69 and the pivot axis 70. An extension passage 72 is conducted out of the oil-supply passage 71 at an end thereof. The end out of which the extension passage 72 is conducted serves as the oil-supply port 58, through which the engine oil 56 is injected to the timer 20.

As shown in FIG. 8(A), the idle gear 69 is fitted onto the pivot axis 70. The pivot axis 70 has a leading end surface 70*a* to which a fall-out preventing plate 74 is attached. The fall-out preventing plate 74 inhibits the idle gear 69 from being dismantled. This fall-out preventing plate 74 has a rear surface formed with a groove-like extension passage 72 extending along the leading end surface 70*a* of the pivot axis 70. The fall-out preventing plate 74 has a peripheral edge opened to provide the oil-supply port 58. The fall-out preventing plate 74 is attached to the pivot axis 70 by attaching bolts 88. Although the groove-like extension passage 72 is formed across the fall-out preventing plate 74 radially thereof for facilitating the working to thereby form oil-supply ports 58 at its opposite ends, only one of the oil-supply ports 58 on the side of the timer 20 is sufficient from the aspect of injecting the engine oil 56 to the timer 20.

What we claim is:

1. An engine comprising an upstream interlocking portion (1) near a crank shaft (49), which is interlockingly connected through a timer (20) to a downstream interlocking portion (2), the timer (20) being provided with a temperature-sensing operation means (7), during a cold-starting while the temperature-sensing operation means (7) senses a temperature of a value less than a predetermined one, the downstream interlocking portion (2) being made to advance by an advancing operation of the timer (20) based on an operation that the temperature-sensing operation means (7) makes upon sensing the temperature, during a warm term of the engine while the temperature-sensing operation means (7) senses a temperature of a value not less than the predetermined one, the downstream interlocking portion (2) canceling its advancement by an advancement-cancellation operation of the timer (20) based on another operation that the temperature-sensing operation means (7) makes upon sensing the temperature, wherein an oil pump (57) for an engine oil (56) is communicated with an oil-supply port (58) and the engine oil (56) within the engine, which has passed an oil gallery within a cylinder block (58*b*), is supplied from the oil-supply port (58) to the timer (20), thereby enabling the engine oil (56) in liquid state to be brought into contact with the temperature-sensing operation means (7), the engine oil (56) transmitting the increase of the engine's temperature to the temperature-sensing operation means (7) to cancel the advancement after the cold-starting.

2. The engine as set forth in claim 1, wherein the timer (20) is arranged within a gear case (76) and the oil-supply port (58) is provided within the gear case (76), the engine oil (56) supplied from the oil-supply port (58) to the timer (20) being flowed from the timer (20) into the gear case (76).

3. The engine as set forth in claim 2, wherein the upstream interlocking portion (1) comprises an upstream interlocking gear (1*b*), and a downstream rotary portion (2) comprises a sleeve (2*c*) fixed to a downstream rotary interlocking shaft (2*b*), an axial direction of the sleeve (2*c*) being taken as a front and rear direction, the timer (20) and the upstream interlocking gear (1*b*) being arranged side by side in the front and rear direction and being externally fitted onto the sleeve (2*c*) as they are.

4. The engine as set forth in claim 3, wherein the upstream interlocking gear (1*b*) has a front and a rear surfaces one of which is provided with a recess portion (1*c*), which accommodates at least part of the timer (20).

5. The engine as set forth in claim 1, wherein the temperature-sensing operation means (7) comprises a shape-memory spring (8), the timer (20) comprises a cam interlocking portion (3*e*) and an eccentric cam mechanism (4), and the eccentric cam mechanism (4) comprises a cam holder (59) to which disk cams (25, 27) are attached, the disk cams (25, 27) being interlockingly connected through the cam interlocking portion (3*e*) to the shape-memory spring (8), the eccentric cam mechanism (4) being made to perform an advancing operation and an advancement-cancellation operation of the timer (20) based on an extending and contracting deformation that the shape-memory spring (8) makes.

6. The engine as set for in claim 3, wherein the oil-supply port (58) is arranged opposite to an interior area of the sleeve (2*c*) and the sleeve (2*c*) has a peripheral wall provided with an oil flow-out port (2*d*), the engine oil (56) being injected from the oil-supply port (58) into the sleeve (2*c*), the thus injected engine oil (56) being flowed out of the oil flow-out port (2*d*) and then supplied to the timer (20) so that it is brought into contact with the temperature-sensing operation means (7).

7. The engine as set forth in claim 6, wherein the timer (20) comprises a cam interlocking portion (3*e*) and an eccentric cam mechanism (4), and the cam interlocking portion (3*e*) comprises a pair of centrifugal weights (3, 3), which are arranged along guide plates (88, 88), the eccentric cam mechanism (4) comprising a cam holder (59) to which disk cams (25, 27) are attached, in order to interlockingly connect these disk cams (25, 27) through the cam interlocking portion (3*e*) to the temperature-sensing operation means (7), thereby enabling the timer (20) to perform the advancing operation and the advancement-cancellation operation based on an operation that the temperature-sensing operation means (7) makes upon sensing a temperature, the engine oil (56) to be flowed out of the oil flow-out port (2*d*) and then be supplied to the timer (20) being also supplied to between the centrifugal weight (3) and the guide plate (88).

8. The engine as set forth in claim 2, wherein the oil-supply port (58) is arranged in a wall of the gear case (76).

9. The engine as set forth in claim 8, wherein an external piping (58*a*) is provided outside an engine's wall, the external piping (58*a*) communicating an oil gallery (58*c*) within the cylinder block (58*b*) with the oil-supply port (58) of the gear case (76).

10. The engine as set forth in claim 3, wherein in order to fix the sleeve (2*c*) to the downstream interlocking rotary shaft (2*b*) through a fastening member (2*e*), the sleeve (2*c*) contains the fastening member (2*e*).

11. The engine as set forth in claim 1, wherein the timer (20) comprises the paired centrifugal weights (3, 3) and the eccentric cam mechanism (4), each of the centrifugal weights (3, 3) being biased in a centripetal direction through a weight-return spring (5) of a compression-coil spring and being interlockingly connected to the eccentric cam mechanism (4), and a force of unbalance between a centrifugal force of each of the paired centrifugal weights (3, 3) and an urging force of the weight-return spring (5) operating the respective centrifugal weights (3, 3), when each of the centrifugal weights (3, 3) moves in a centrifugal direction, it advances the downstream interlocking portion (2) with respect to the upstream interlocking portion (1) through the eccentric cam mechanism (4) and when each of the paired centrifugal weights (3, 3) moves in a centripetal direction, it lags the downstream interlocking portion (2) with respect to the upstream interlocking portion (1) through the eccentric cam mechanism (4), and wherein each of the paired centrifugal weights (3, 3) is interlockingly connected to an advancing spring (6), composed of a compression-coil spring, which is interlockingly connected to the temperature-sensing operation means (7), when starting the engine during a cold term, the advancing spring (6) being maintained extensible based on a state of the temperature-sensing operation means (7), in which the temperature-sensing means (7) senses a temperature to operate, and exerting a spring force which pushes and widens the paired centrifugal weights (3, 3) to an advancing position (Ac) for cold-starting the engine and while the engine is warm, the advancing spring (6) being held contracted based on another state of the temperature-sensing operation means (7), in which the temperature-sensing operation means (7) senses a temperature to operate, so that the spring force of the advancing spring (6) does not act on the pair of centrifugal weights (3, 3), a shape-memory spring (8) of a compression-coil spring being used for the temperature-sensing operation means (7), the shape-memory spring (8) and the advancing spring (6) being interposed between the pair of centrifugal weights (3, 3) in a position concentric with the weight-return spring (5).

12. The engine as set forth in claim 11, wherein one of the paired centrifugal weights (3, 3) has an interior area formed with a spring-accommodating hole (3*a*) which accommodates the weight-return spring (5) and the other of the paired centrifugal weights (3, 3) has an interior area provided with another spring-accommodating hole (3*a*) which accommodates the advancing spring (6) and the shape-memory spring (8).

13. The engine as set forth in claim 12, wherein the shape-memory spring (8) and the advancing spring (6) are formed into a double structure where one of them is arranged inside and the other is disposed outside.

14. The engine as set forth in claim 13, wherein the spring-accommodating hole (3*a*) of the centrifugal weight (3), which accommodates the advancing spring (6), has an inner bottom provided with a first spring seat (3*b*), on which the advancing spring (6) has its base end portion (12) seated, and a transmission cylinder (9) is concentrically arranged within the advancing spring (6) and has a leading end portion near a leading end portion (13) of the advancing spring (6), this leading end portion of the transmission cylinder (9) being provided with a first spring retainer (10) outwardly, the first spring retainer (10) receiving the leading end portion (13) of the advancing spring (6) and being brought into contact with a retainer-receiving surface (3*c*) of the centrifugal weight (3) which accommodates the weight-return spring (5), and wherein an axis (14) is attached to the centrifugal weight (3) which accommodates the advancing spring (6) and is concentrically arranged within the transmission cylinder (9), the axis (14) being provided with a second spring seat (14*a*) on which the shape-memory spring (8) has its base end portion (15) seated, and the shape-memory spring (8) is concentrically arranged between the axis (14) and the transmission cylinder (9), the transmission cylinder (9) having another leading end portion close to a leading end portion (16) of the shape-memory spring (8), this another leading end portion of the transmission cylinder (9) being provided with a second spring retainer (11) inwardly, the second spring retainer (11) receiving the leading end portion (16) of the shape-memory spring (8), when starting the engine during the cold term, the advancing spring (6) being maintained extensible based on a state of the contracted shape-memory spring (8) in which the shape-memory spring (8) senses a temperature to operate, and being made to act its spring force on the first spring seat (3*b*) and the retainer-receiving surface (3*c*), thereby enabling the paired centrifugal weights (3, 3) to be pushed and widened to the advancing position (Ac), while the engine is warm, the advancing spring (6) being held contracted based on another state of the extended shape-memory spring (8), in which the shape memory spring (8) senses a temperature to operate, so that the spring force of the advancing spring (6) does not act on the first spring seat (3*b*) and the retainer-receiving surface (3*c*).

15. The engine as set forth in claim 1, wherein a first limiting member of advancement (41) and a second limiting member of advancement (42) are interlockingly connected to a shape-memory spring (8) through an output means (39) and a limitation switch-over means (44) so that they are able to be switched over, when starting the engine during the cold term, the first limiting member of advancement (41) being able to make limitation, based on the state of the shape-memory spring (8), in which the shape-memory spring (8) senses a temperature to operate, through the output means (39) and the limitation switch-over means (44) and confining an upper limit of a movement of every centrifugal weight (3) in a centrifugal direction to a first limiting position of advancement (L1), while the engine is warm, the second limiting member of advancement (42) being able to make limitation, based on another state of the shape-memory spring (8), in which the shape-memory spring (8) senses a temperature to operate, through the output means (39) and the limitation switch-over means (44) and confining the upper limit of the movement of every centrifugal weight (3) in the centrifugal direction to a second limiting position of advancement (L2), the second limiting position of advancement (L2) being arranged so that the upper limit of the movement of every centrifugal weight (3) in the centrifugal direction is set lower so as to make un upper limit of a degree of advancement (θ) lower when compared with the first limiting position of advancement (L1).

16. The engine as set forth in claim 15, wherein a rotating plate (44*a*) is used for the limitation switch-over means (44) and is provided at one lateral portion of a paired centrifugal weights (3, 3), the rotating plate (44*a*) being able to rotate around a center line (18) of rotation of the downstream interlocking portion (2), and the rotating plate (44*a*) is opened to provide a first limiting hole of advancement (46) and a second limiting hole of advancement (47) both of which are arranged side by side in a rotation direction of the centrifugal weight (3) and are communicated with each other to provide a communication hole (45), the first limiting hole of advancement (46) having a peripheral edge portion on a centrifugal side, which forms the first limiting member of advancement (41) and the second limiting hole of advancement (47) having a peripheral edge portion on the centrifugal side, which forms the second limiting member of advancement (42), respectively, each of the paired centrifugal weights (3, 3) projecting an engaging projection (48) into the communication hole (45), when starting the engine during the cold term, the rotating plate (44*a*) being placed in a first position based on the state of the shape-memory spring (8) in which the shape-memory spring (8) senses a temperature to operate, the first limiting member of advancement (41) being able to receive the engaging projection (48), while the engine is warm, the rotating plate (44*a*) being placed in a second position based on another state of the shape-memory spring (8) in which the shape-memory spring (8) senses a temperature to operate, the second limiting member of advancement (42) being able to receive the engaging projection (48).

17. The engine as set forth in claim 16, wherein the rotating plate (44*a*) is provided at one lateral portion of the paired centrifugal weights (3, 3) and on the other hand, a eccentric cam mechanism (4) is arranged at the other lateral portion thereof, a pin (28) passing through each of the centrifugal weights (3, 3) and having one end portion which serves as the engaging projection (48) and having the other end portion which serves as an output pin (3*d*) extending from each of the centrifugal weighs (3, 3) to the eccentric cam mechanism (4).

18. The engine as set forth in claim 16, wherein an output pin (39*a*) is used for the output means (39) from the shape-memory spring (8) and the rotating pin (44*a*) is opened to provide an engaging hole (38) with which the output pin (39*a*) engages.

19. An engine comprising an upstream interlocking portion (1) near a crank shaft (49), which is interlockingly connected through a timer (20) to a downstream interlocking portion (2), the timer (20) being provided with a temperature-sensing operation means (7), during a cold-starting while the temperature-sensing operation means (7) senses a temperature of a value less than a predetermined one, the downstream interlocking portion (2) being made to advance by an advancing operation of the timer (20) based on an operation that the temperature-sensing operation means (7) makes upon sensing the temperature, during a warm term of the engine while the temperature-sensing operation means (7) senses a temperature of a value not less than the predetermined one, the downstream interlocking portion (2) canceling its advancement by an advancement-cancellation operation of the timer (20) based on another operation that the temperature-sensing operation means (7) makes upon sensing the temperature, wherein an oil pump (57) for an engine oil (56) is communicated with an oil-supply port (58) and the engine oil (56) within the engine is supplied from the oil-supply port (58) to the timer (20), thereby enabling the engine oil (56) in liquid state to be brought into contact with the temperature-sensing operation means (7), and the timer (20) comprises the eccentric cam mechanism (4), the cam holder (59) and the cam driving plate (60) are arranged as they are superposed one on another, disk cams (25, 25, 27, 27) being attached to the cam holder (59), input pins (65, 65) being attached to the predetermined disk cams (25, 25), the cam driving plate (60) being provided with the guide holes (67, 67) into which the input pins (65, 65) are internally fitted, a pair of support portions (60*b*, 59*b*) projecting from an end surface (60*a*) of the cam driving plate (60) and from an end surface (59*a*) of the cam holder (59) exposed laterally of the cam driving plate (60), the temperature-sensing operation means (7) being arranged as exposed between the pair of support portions (60*b*, 59*b*), the cam driving plate (60) being rotated based on the deformation of the temperature-sensing operation means (7), the disk cams (25, 27) being driven through the guide holes (67, 67) and the input pins (65, 65), thereby enabling the timer (20) to perform the advancing operation and the advancement-cancellation operation.

20. The engine as set forth in claim 19, wherein an axial direction of a sleeve (2*c*) is taken as a front and rear direction, and an optional one of the front and rear direction is determined as 'front' and the other is defined as 'rear', an upstream interlocking gear (1*b*), which form the upstream interlocking portion (1), the cam holder (59) and the cam driving plate (60) being attached to the sleeve (2*c*) in the mentioned order from the front as they are superposed one on another, the pair of support portions (60*b*, 59*b*) projecting from the rear end surface (60*a*) of the cam driving plate (60) and from the rear end surface (59*a*) of the cam holder (59) exposed laterally of the cam driving plate (60), the temperature-sensing operation means (7) being arranged between the pair of support portions (60*b*, 59*b*) as it is exposed, the upstream interlocking gear (1*b*) engaging with an idle gear (69), the idle gear (69) having a pivot axis (70) provided with an oil-supply passage (71) which supplies the engine oil (56) to between the idle gear (69) and the pivot axis (70), an extension passage (72) being conducted out of the oil-supply passage (71) at an end thereof, the end from which the extension passage (72) is conducted being made to serve as the oil-supply port (58) through which the engine oil (56) is injected to the timer (20).

21. The engine as set forth in claim 20, wherein the idle gear (69) is fitted onto the pivot axis (70) which has a leading end surface (70*a*) provided with a fall-out preventing plate (74), the fall-out preventing plate (74) inhibiting the idle gear (69) from being dismantled and having a rear surface formed with a groove-like extension passage (72) which extends along the leading end surface (70*a*) of the pivot axis (70), the fall-out preventing plate (74) having a peripheral edge opened to provide the oil-supply port (58).

* * * * *